US012565837B2

(12) United States Patent
Wang et al.

(10) Patent No.: US 12,565,837 B2
(45) Date of Patent: Mar. 3, 2026

(54) TUNNEL TUNNELING SYSTEM

(71) Applicants: CCTEG TAIYUAN RESEARCH INSTITUTE, Taiyuan (CN); SHANXI TIANDI COAL MINING MACHINERY CO., LTD., Taiyuan (CN)

(72) Inventors: Hong Wang, Taiyuan (CN); Bukang Wang, Taiyuan (CN); Xiaofeng Zhang, Taiyuan (CN); Kai Ma, Taiyuan (CN); Yongcheng Ding, Taiyuan (CN); Faquan Li, Taiyuan (CN); Jianwei Jia, Taiyuan (CN); Qiang Ma, Taiyuan (CN); Mingjiang Song, Taiyuan (CN); Yanhua Qiao, Taiyuan (CN); Ningning Wang, Taiyuan (CN); Gehui Xie, Taiyuan (CN); Feng Liu, Taiyuan (CN); Xiaoli Ren, Taiyuan (CN); Sen Xu, Taiyuan (CN); Qiang Zhang, Taiyuan (CN); Dong Song, Taiyuan (CN); Wei Wang, Taiyuan (CN); Xipeng Wang, Taiyuan (CN); Xuerui Zhang, Taiyuan (CN); Shengyuan Sang, Taiyuan (CN); Jingxi Duan, Taiyuan (CN); Shouxin Hu, Taiyuan (CN); Zhiwei Yan, Taiyuan (CN); Weijian Qiu, Taiyuan (CN); Jinbao Yan, Taiyuan (CN)

(73) Assignees: CCTEG TAIYUAN RESEARCH INSTITUTE, Taiyuan (CN); SHANXI TIANDI COAL MINING MACHINERY CO., LTD., Taiyuan (CN)

( * ) Notice: Subject to any disclaimer, the term of this patent is extended or adjusted under 35 U.S.C. 154(b) by 152 days.

(21) Appl. No.: 18/562,615

(22) PCT Filed: Jun. 1, 2022

(86) PCT No.: PCT/CN2022/096659
§ 371 (c)(1),
(2) Date: Nov. 20, 2023

(87) PCT Pub. No.: WO2023/077792
PCT Pub. Date: May 11, 2023

(65) Prior Publication Data
US 2024/0240560 A1 Jul. 18, 2024

(30) Foreign Application Priority Data
Nov. 8, 2021 (CN) ..... 202111323735.4

(51) Int. Cl.
*E21D 9/00* (2006.01)
*E21C 25/10* (2006.01)
(Continued)

(52) U.S. Cl.
CPC ..... *E21C 35/282* (2023.05); *E21C 25/10* (2013.01); *E21C 39/00* (2013.01); *E21C 41/18* (2013.01);
(Continued)

(58) Field of Classification Search
CPC ..... E21C 35/282; E21C 25/10; E21C 39/00; E21C 41/18; E21C 35/20; E21D 9/03; E21D 20/003; E21D 9/1013; E21D 9/12
See application file for complete search history.

(56) References Cited

U.S. PATENT DOCUMENTS

2005/0129466 A1* 6/2005 Walker ..... E21D 20/003 405/303
2010/0119310 A1* 5/2010 Yan ..... E21B 7/025 405/259.1
(Continued)

FOREIGN PATENT DOCUMENTS

CN 101922290 A 12/2010
CN 103899319 A 7/2014
(Continued)

OTHER PUBLICATIONS

International Search Report corresponding to PCT Application No. PCT/CN2022/096659, mailed Aug. 17, 2022 (Chinese and English language document) (7 pages).

(Continued)

*Primary Examiner* — Carib A Oquendo
(74) *Attorney, Agent, or Firm* — Maginot, Moore & Beck, LLP

(57) ABSTRACT

A tunnel tunneling system includes a bolter miner, a bolter-integrated transportation machine, a transfer machine, a self-moving tail and a belt conveyor. The bolter miner includes a rack, a cutting device, a drilling device and a control device. The cutting device is arranged on the rack and is swingable in an up-down direction, and has a lowest swing angle and a highest swing angle. The drilling device is arranged on the rack, and includes a drilling rig and a sensor. The drilling rig is configured to drill a tunnel floor and/or a tunnel roof, and the sensor is configured to monitor a set parameter of the drilling rig and generate a monitoring data signal when the drilling rig is drilling. The control device is configured to receive and analyze the monitoring data signal.

12 Claims, 10 Drawing Sheets

(51) Int. Cl.

| | |
|---|---|
| ***E21C 35/00*** | (2006.01) |
| ***E21C 39/00*** | (2006.01) |
| ***E21C 41/18*** | (2006.01) |
| ***E21D 9/10*** | (2006.01) |
| ***E21D 9/12*** | (2006.01) |
| ***E21D 20/00*** | (2006.01) |

(52) U.S. Cl.
CPC ..... *E21D 9/003* (2013.01); *E21D 9/03* (2016.01); *E21D 9/1013* (2013.01); *E21D 9/12* (2013.01); *E21D 20/003* (2013.01)

(56) References Cited

U.S. PATENT DOCUMENTS

| | | | | |
|---|---|---|---|---|
| 2010/0221071 | A1* | 9/2010 | Hinshaw | E21F 17/18 405/259.1 |
| 2019/0352968 | A1* | 11/2019 | Kivelä | E21B 7/025 |

FOREIGN PATENT DOCUMENTS

| | | | | |
|---|---|---|---|---|
| CN | 205277431 | U | 6/2016 | |
| CN | 105971599 | A | 9/2016 | |
| CN | 107191191 | A | 9/2017 | |
| CN | 109387884 | A | 2/2019 | |
| CN | 113339074 | A | 9/2021 | |
| CN | 114017020 | A | 2/2022 | |
| CN | 114017022 | A | 2/2022 | |
| CN | 114033414 | A | 2/2022 | |
| WO | WO-2018228217 | A1 * | 12/2018 | E21C 35/22 |
| WO | 2019/025959 | A1 | 2/2019 | |

OTHER PUBLICATIONS

Office Action for corresponding AU application No. 2022380886, mailed Jan. 24, 2025 (6 pages).

* cited by examiner

TUNNEL TUNNELING SYSTEM

CROSS-REFERENCE TO RELATED APPLICATIONS

The present application is a national phase entry under 35 USC § 371 of International Application No. PCT/CN2022/096659, filed on Jun. 1, 2022, which claims the benefit of and priority to Chinese Application No. 202111323735.4, filed on Nov. 8, 2021, the entire disclosures of which are incorporated herein by reference.

FIELD

The present disclosure relates to a field of tunnel tunneling, and more particularly to a tunnel tunneling system.

BACKGROUND

A tunneling system is one of six major systems in a coal mine, and the tunneling system is mainly used for tunneling and bolt support construction of underground tunnels. The tunneling system includes apparatuses such as a heading machine, a transfer machine, a belt conveyor, and so on. The heading machine cuts a coal wall at a heading face, and coal rock generated by the cutting needs to be conveyed to the ground through the subsequent transfer machine and belt conveyor, so as to complete the tunneling of the tunnel. In the related art, the tunneling system has problems of low recovery rate and tunneling efficiency, and easy damage to tunneling apparatuses during tunneling.

SUMMARY

A tunnel tunneling system according to embodiments of the present disclosure includes: a bolter miner including a rack, a cutting device, a drilling device and a control device, wherein the cutting device is arranged on the rack and is swingable in an up-down direction, and the cutting device has a lowest swing angle and a highest swing angle; the drilling device is arranged on the rack, the drilling device includes a drilling rig and a sensor, the drilling rig is configured to drill a tunnel floor and/or a tunnel roof, and the sensor is configured to monitor a set parameter of the drilling rig and generate a monitoring data signal when the drilling rig is drilling; the control device is configured to receive and analyze the monitoring data signal; in a process of drilling the tunnel floor by a first thickness through the drilling rig, the control device is configured to reduce the lowest swing angle in response to that the monitoring data signal is greater than a first threshold; and in a process of drilling the tunnel roof by a second thickness through the drilling rig, the control device is configured to reduce the highest swing angle in response to that the monitoring data signal is greater than a second threshold; a bolter-integrated transportation machine arranged behind the bolter miner and configured to transfer coal rock cut and conveyed by the bolter miner; a transfer machine and a self-moving tail, wherein one end of the transfer machine is connected with the bolter-integrated transportation machine and is configured to move synchronously with the bolter-integrated transportation machine, the transfer machine is arranged behind the bolter-integrated transportation machine, the transfer machine is configured to transfer the coal rock conveyed by the bolter-integrated transportation machine, the other end of the transfer machine is lapped with the self-moving tail, and the self-moving tail is configured to transfer the coal rock conveyed by the transfer machine and to move backwards for retreat; and a belt conveyor arranged behind the self-moving tail, and configured to transfer the coal rock conveyed by the self-moving tail.

DETAILED DESCRIPTION

Figure 1:
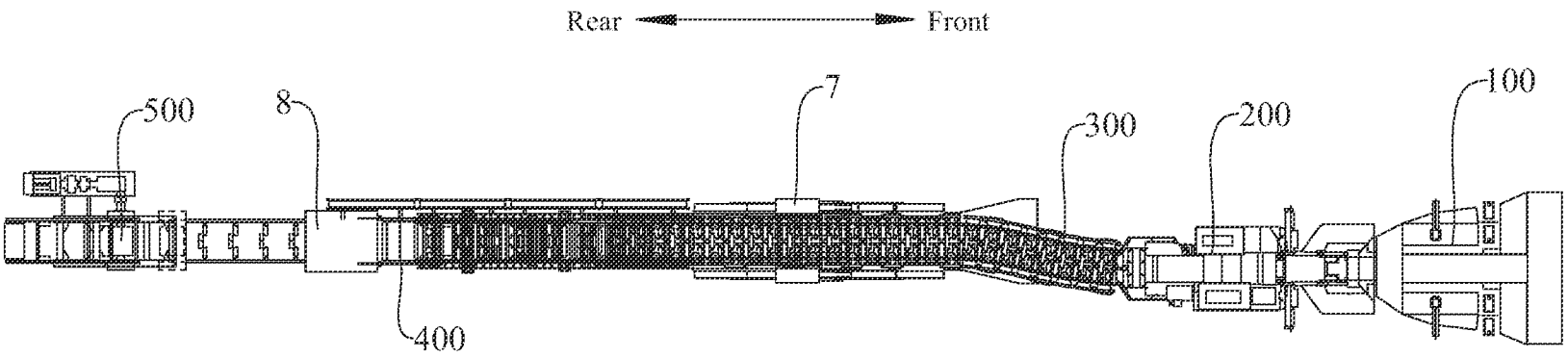
FIG. 1 is a top view of a tunnel tunneling system according to an embodiment of the present disclosure.

Reference will be made in detail to embodiments of the present disclosure, and examples of the embodiments are shown in the accompanying drawings. The embodiments described herein with reference to the drawings are illustrative, and are intended to explain the present disclosure, but shall not be construed to limit the present disclosure.

As shown in FIGS. 1-17, the tunnel tunneling system according to embodiments of the present disclosure includes a bolter miner 100, a bolter-integrated transportation machine 200, a transfer machine 300, a self-moving tail 400 and a belt conveyor 500.

The bolter miner 100 may be arranged at a frontmost end of the tunnel tunneling system, and the bolter miner 100 includes a rack 1, a cutting device 2, a drilling device 3 and a control device (not shown).

Figure 6:
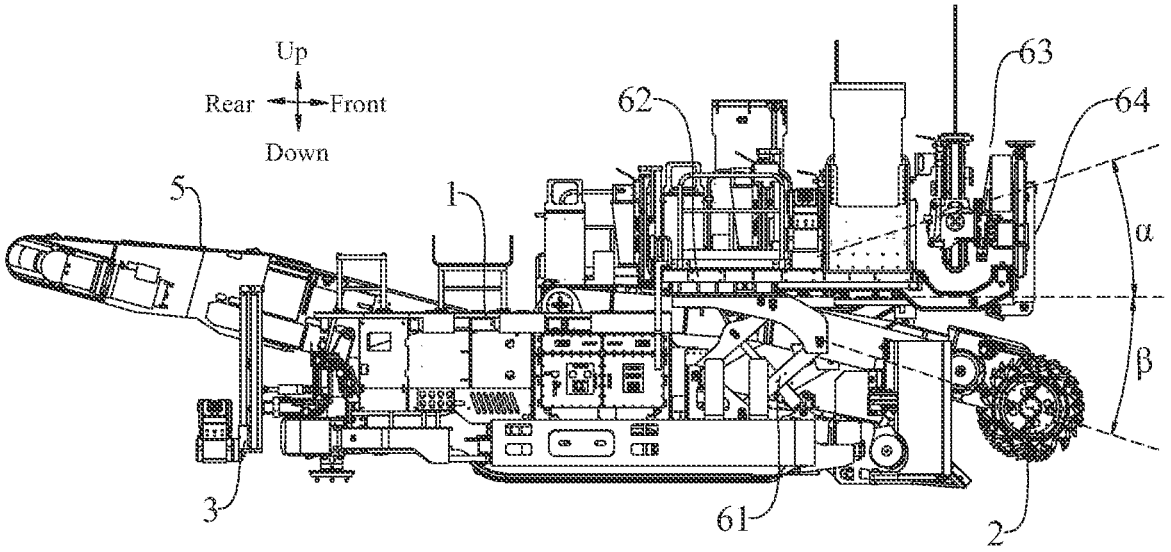
FIG. 6 is a right view of a bolter miner in FIG. 1.

The rack 1 is a body frame of the bolter miner 100, and the rack 1 may be formed by tailor-welding profiles. As shown in FIG. 6, the rack 1 may extend and be arranged generally in a front-rear direction. The bolter miner 100 may further include a walking device, a shovel plate device 4, a conveying trough device 5, and so on. The walking device, the cutting device 2, the shovel plate device 4 and the conveying trough device 5 are all assembled on the rack 1.

It should be noted that, both the cutting device 2 and the shovel plate device 4 are arranged at a front end of the rack 1. The cutting device 2 includes a cutting drum 21, and the shovel plate device 4 is located below the cutting drum 21. The conveying trough device 5 extends along a length direction of the rack 1 (i.e., the front-rear direction). Coal rock cut by the cutting drum 21 may be gathered by the shovel plate device 4 and conveyed to a front inlet of the conveying trough device 5, and then the coal rock may be conveyed backwards by the conveying trough device 5.

The walking device may be a crawler-type walking device, and may be mounted below the rack 1. Automatic movement of the bolter miner 100 can be achieved by the walking device.

The cutting device 2 is arranged on the rack 1 and is swingable in an up-down direction. The cutting device 2 includes a lowest swing angle and a highest swing angle. At the lowest swing angle, the cutting device 2 is configured to cut coal rock at a bottom of a working face, and at the highest swing angle, the cutting device 2 is configured to cut coal rock at a top of the working face.

Figure 5:
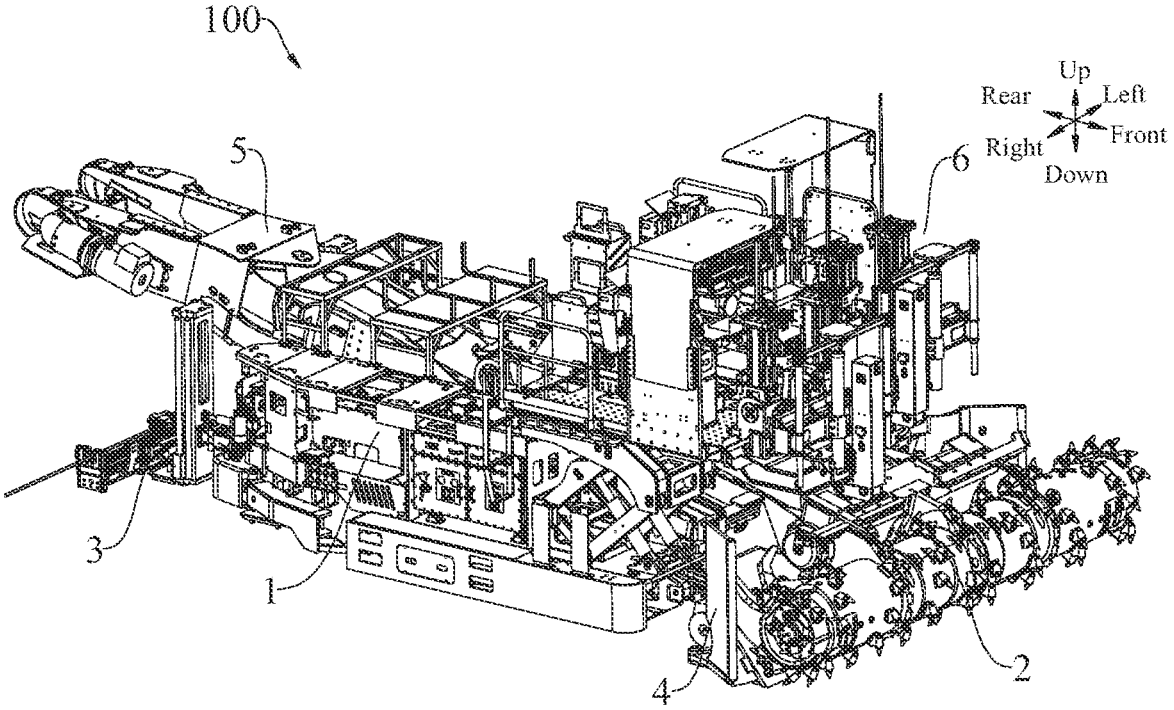
FIG. 5 is a front perspective view of a bolter miner in FIG. 1.

Specifically, as shown in FIGS. 5 and 6, the cutting device 2 is arranged on a front side of the rack 1. The cutting device 2 may include a cutting arm and the cutting drum 21. The cutting arm generally extends in the front-rear direction, and a rear end of the cutting arm is connected to the rack 1 and is swingable relative to the rack 1 in the up-down direction. For example, the rear end of the cutting arm may be rotatably connected to the rack 1 through a pivot shaft. The cutting drum 21 is assembled at a front end of the cutting arm, and the cutting drum 21 is provided with cutting teeth and may rotate by itself. When in use, the cutting arm swings up and down to drive the cutting drum 21 to move up and down, and the rotating cutting drum 21 will cut a coal wall, thus realizing a cutting operation on the front coal wall.

As shown in FIG. 6, the cutting arm may have a highest swing angle $\alpha$ and a lowest swing angle $\beta$ during an up-and-down swing stroke of the cutting arm. The highest swing angle $\alpha$ is a maximum upward swing angle of the cutting arm during actual use, that is, an included angle between an axial direction of the cutting arm and a horizontal direction after the cutting arm swings upwards. The lowest swing angle $\beta$ is a maximum downward swing angle of the cutting arm during actual use, that is, the included angle between the axial direction of the cutting arm and the horizontal direction after the cutting arm swings downwards.

It should be noted that when the cutting arm swings to the highest swing angle $\alpha$, the cutting drum 21 may cut a top of a heading working face; and when the cutting arm swings to the lowest swing angle $\beta$, the cutting drum 21 may cut a bottom of the heading working face. By swinging the cutting arm within a range formed by the highest swing angle $\alpha$ and the lowest swing angle $\beta$, the cutting operation on the coal wall of the heading working face can be completed.

The drilling device 3 is arranged on the rack 1 and includes a drilling rig 31 and a sensor electrically connected to the drilling rig 31. The drilling rig 31 is configured to drill a tunnel floor and/or a tunnel roof. The sensor is configured to monitor set parameters of the drilling rig 31 and generate a monitoring data signal when the drilling rig 31 is drilling.

Specifically, the drilling rig 31 may be a roof bolter and may perform drilling operations such as hole drilling and rock sampling. The set parameters of the drilling rig 31 may include a propulsion force of the drilling rig 31, and in this case, the sensor may be a pressure sensor. When the drilling rig 31 drills holes on the tunnel floor or the tunnel roof, the sensor may monitor a reverse force exerted by a stratum on the drilling rig 31. The reverse force and the propulsion force required by the drilling rig 31 may be regarded as interaction forces, so that the propulsion force of the drilling rig 31 may be monitored.

Since different strata have different lithology, the drilling rig 31 needs to exert different propulsion forces during drilling operations. For example, the drilling rig 31 needs to exert a relatively small propulsion force when drilling a coal seam due to its soft texture; and the drilling rig 31 needs to exert a relatively large propulsion force when drilling a rock stratum due to its hard texture. By monitoring different propulsion forces, it may be judged whether the drilling rig 31 is drilling the rock stratum or the coal seam.

It may be understood that in some other embodiments, the set parameters of the drilling rig 31 may also be parameters that can reflect properties of the stratum, such as a working power and a hydraulic system pressure of the drilling rig 31. In this case, the sensor is one that may monitor the corresponding parameters.

The sensor is electrically connected to the control device, and the control device is configured to receive and analyze the monitoring data signal. When the drilling rig 31 is drilling the tunnel floor by a first thickness, the control device is configured to reduce the lowest swing angle if the monitoring data signal is greater than a first threshold. When the drilling rig 31 is drilling the tunnel roof by a second thickness, the control device is configured to reduce the highest swing angle if the monitoring data signal is greater than a second threshold.

Specifically, the control device may be a PLC control system, but it may also be other types of controllers or processors. The sensor may be electrically connected to the control device through wires. In some other embodiments, the sensor may also transmit data signals to the control device through wireless transmission. The control device may be fixed on an inner side of the rack 1, so as to provide a protective effect.

The monitoring data signal monitored by the sensor may be transmitted to the control device, and the control device may convert the received monitoring data signal into a numerical parameter, which may be compared with the preset first threshold or second threshold. Finally, the swing of the cutting arm is controlled based on a comparison result. The first threshold is a numerical parameter corresponding to a propulsion force when breaking through an interface between a coal seam and a rock stratum below the coal seam, and the second threshold is a numerical parameter corresponding to a propulsion force when breaking through an interface between the coal seam and a rock stratum above the coal seam.

It should be noted that the first thickness is a floor thickness drilled by the drilling rig 31 when drilling the tunnel floor, and the second thickness is a roof thickness drilled by the drilling rig 31 when drilling the tunnel roof. The first thickness and the second thickness need to be selected according to requirements and experiences. For example, the first thickness may be a remaining coal seam thickness allowed by the floor, and the second thickness may be a remaining coal seam thickness allowed by the roof.

For example, when the drilling rig 31 is drilling the tunnel floor by the first thickness, the control device may receive the monitoring data signal in real time, and after receiving the monitoring data signal, the control device compares the monitoring data signal with the first threshold. When the numerical parameter corresponding to the monitoring data signal is greater than the first threshold, it may be determined that the cutting device 2 has cut to or near the rock stratum below the coal seam. By reducing the lowest swing angle β of the cutting arm through the control device, the cutting drum 21 of the cutting device 2 may be prevented from continuing cutting the rock stratum below.

In a process of drilling the tunnel roof by the drilling rig 31, the control device may receive the monitoring data signal in real time and compare the monitoring data signal with the second threshold after receiving the monitoring data signal. When the numerical parameter corresponding to the monitoring data signal is greater than the second threshold, it may be determined that the cutting device 2 has cut to or near the rock stratum above the coal seam. By reducing the highest swing angle α of the cutting arm through the control device, the cutting drum 21 of the cutting device 2 may be prevented from continuing cutting the rock stratum above.

It should be noted that with the advancement of the bolter miner 100, the drilling operation may be carried out at each cycle footage or at intervals of a set number of tunneling cycle footage. The timing for the drilling operation may be selected as required.

It may be understood that a monitor for identifying whether the drilling device 3 is drilling the tunnel roof or the tunnel floor may be added in the present disclosure. The monitor may be a position monitor, such as an infrared monitor, which may monitor a position change of the drilling device 3, so as to provide a basis for the control device to judge whether the tunnel roof or the tunnel floor is being drilled.

Figure 2:
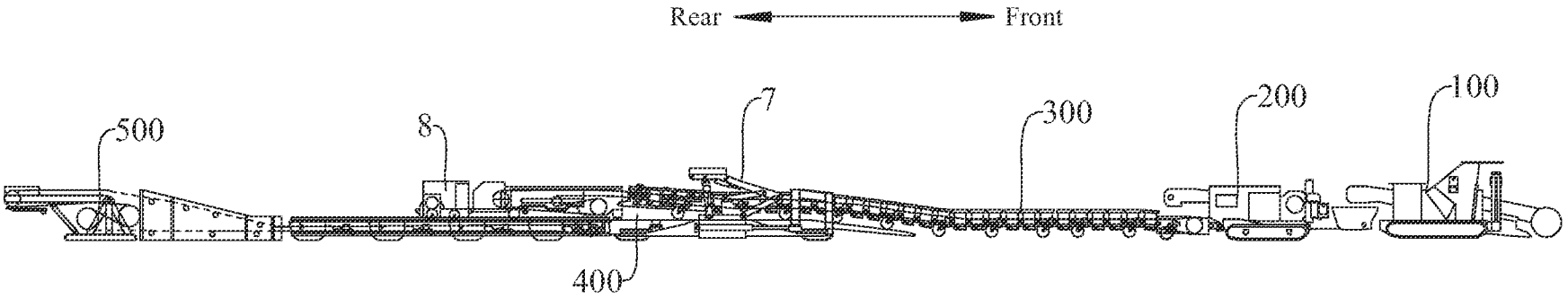
FIG. 2 is a side view of a tunnel tunneling system according to an embodiment of the present disclosure.

The bolter-integrated transportation machine 200 is arranged behind the bolter miner 100 and is configured to transfer coal rock cut and conveyed by the bolter miner 100. Specifically, as shown in FIG. 1 and FIG. 2, the bolter-integrated transportation machine 200 is located on a rear side of the bolter miner 100 and is arranged adjacent to the bolter miner 100. During use, the bolter-integrated transportation machine 200 may move synchronously with the bolter miner 100. For example, after the bolter miner 100 is advanced by one cycle footage, the bolter-integrated transportation machine 200 may be moved forwards by one cycle footage synchronously. Consequently, the bolter-integrated transportation machine 200 can transfer the coal rock conveyed from the conveying trough device of the bolter miner 100 at any time.

It should be noted that, the bolter-integrated transportation machine 200 also has the function of bolt support, and the bolter-integrated transportation machine 200 may include a roof bolter, so that the bolter-integrated transportation machine 200 can perform the bolt support on the rear side of the bolter miner 100 simultaneously during the bolt support of the bolter miner 100, which is beneficial to improving the tunneling efficiency.

One end of the transfer machine 300 is connected with the bolter-integrated transportation machine 200 and may move synchronously with the bolter-integrated transportation machine 200, and the transfer machine 300 is arranged behind the bolter-integrated transportation machine 200. The transfer machine 300 is configured to transfer the coal rock conveyed by the bolter-integrated transportation machine 200, and the other end of the transfer machine 300 is lapped with the self-moving tail 400. The self-moving tail 400 is configured to transfer the coal rock conveyed by the transfer machine 300, and the self-moving tail 400 is configured to move backwards for retreat.

Specifically, as shown in FIGS. 1 and 2, the transfer machine 300 may be arranged behind and adjacent to the bolter-integrated transportation machine 200. A front end of the transfer machine 300 may be connected with the bolter-integrated transportation machine 200 by a pin shaft, and a rear end of the transfer machine 300 may be lapped with the self-moving tail 400. The transfer machine 300 is configured to slide by itself relative to the self-moving tail 400. Consequently, when the bolter-integrated transportation machine 200 is moved forwards, the transfer machine 300 can be moved forwards synchronously with the bolter-integrated transportation machine 200, and the rear end of the transfer machine 300 slides forwards along the self-moving tail 400.

A rear end of the self-moving tail 400 may be provided with a traction part, and the traction part may be a rack and pinion traction part, a hydraulic cylinder traction part or the like. The traction part may drive the self-moving tail 400 to move backwards, so that when the tunnel tunneling system needs to turn or retreat, the self-moving tail 400 may retreat by itself, thereby improving the maneuverability and flexibility of the tunnel tunneling system.

The belt conveyor 500 is arranged behind the self-moving tail 400, and the belt conveyor 500 is configured to transfer the coal rock conveyed by the self-moving tail 400. Specifically, as shown in FIGS. 1 and 2, the belt conveyor 500 may be connected with the rear end of the self-moving tail 400, and the coal rock conveyed via the self-moving tail 400 may be directly transferred to the belt conveyor 500, and then may be transported to a main tunnel or the ground via the belt conveyor 500.

In the tunnel tunneling system according to embodiments of the present disclosure, since a cutting direction of the cutting device 2 can be corrected in time by the drilling device 3 and the control device, the cutting device 2 can be prevented from cutting roof and floor rock strata, allowing the cutting device 2 to always perform cutting operations in the coal seam. Since the situation of cutting roof and floor rock strata is avoided, a situation that a large deviation of the cutting direction causes a large amount of coal resources left in a roof coal seam or a floor coal seam opposite to the deviation direction is avoided, thus improving the recovery rate.

Moreover, since an advancing direction of the tunnel tunneling system can be adjusted and corrected in time, the situation that a tunneling direction is deviated greatly in the related art is avoided. On the one hand, a tunneling path of the tunnel tunneling system is reduced and optimized, and on the other hand, the situation that much time is wasted to correct the tunneling direction which is deviated greatly is avoided, thus ensuring the tunneling efficiency.

In addition, since the bolter miner 100 works in the coal seam, it is possible to prevent the bolter miner 100 from cutting the hard rock stratum and hence from being easily damaged because of cutting the rock stratum. Consequently, a smooth progress of the tunneling operation is ensured, the equipment service life is prolonged, the mining amount of gangue is reduced, and the environmental-friendly and efficient mining of the coal seam is realized.

In some embodiments, the self-moving tail 400 includes a self-moving bracket 7 and a driving device 8, the self-moving bracket 7 is arranged at a front end of the self-moving tail 400, and the driving device 8 is arranged at the rear end of the self-moving tail 400. The self-moving tail 400 may walk to drive the self-moving tail 400 to move forwards, and the driving device 8 is configured to drive the self-moving tail 400 to move backwards.

Figure 3:
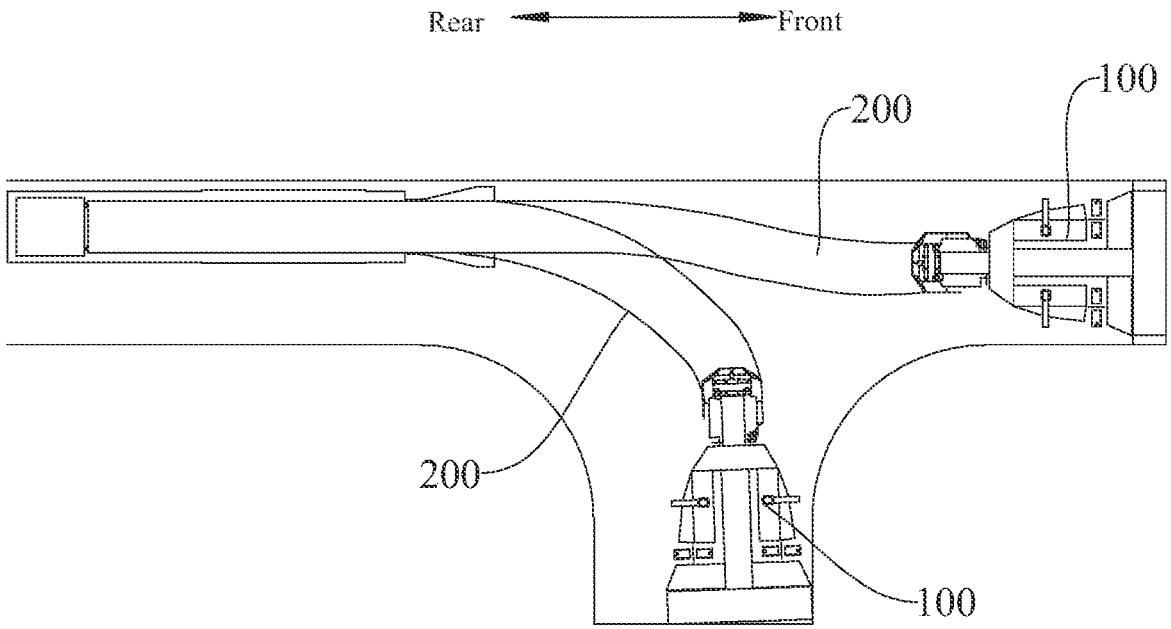
FIG. 3 is a schematic view of bending of a transfer machine according to an embodiment of the present disclosure.
Figure 4:
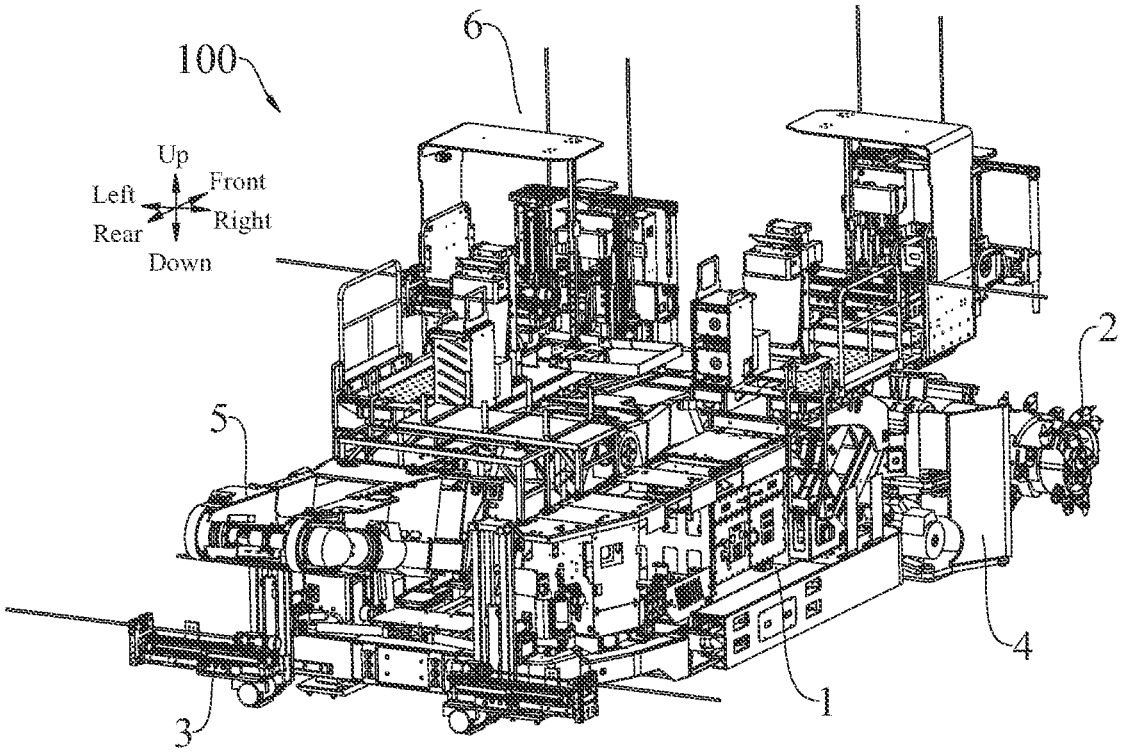
FIG. 4 is a rear perspective view of a bolter miner in FIG. 1.

Specifically, as shown in FIGS. 1-3, the self-moving bracket 7 may be a walking hydraulic bracket, and the self-moving bracket 7 includes an upright oil cylinder and a driving oil cylinder. When in use, the upright oil cylinder may be supported between the tunnel roof and the tunnel floor, and then the driving oil cylinder may be retracted to pull the self-moving tail 400. Before pulling, the upright oil cylinder may be retracted, and then the upright oil cylinder may be pushed forwards by means of the driving oil cylinder. Consequently, this facilitates the automatic forward movement of the self-moving tail 400.

The driving device 8 may be a driving gear, and a front end of the belt conveyor 500 may be provided with a pin rail. The driving gear and the pin rail are meshed for transmission, and the self-moving tail 400 is moved backwards through the rotation of the driving gear. The arrangement of the self-moving bracket 7 and the driving device 8 facilitates the forward and backward adjustment of the position of the self-moving tail 400.

In some embodiments, as shown in FIG. 3, the transfer machine 300 may be bent in the left-right direction. For example, the transfer machine 300 may include a plurality of transport units, and two adjacent transport units may swing slightly relative to each other in the up-down direction and the left-right direction, thus achieving the flexibility of the transfer machine 300. Consequently, the turning of the tunneling system is facilitated, and the tunneling flexibility of the tunneling system is improved.

In some embodiments, the drilling device 3 includes a lifting assembly 32, and the lifting assembly 32 is connected with the rack 1. The drilling rig is arranged on the lifting assembly 32 and is configured to install an anchor rod. The drilling rig is rotatably connected with the lifting assembly 32, and the drilling rig is swingable in a height direction and the length direction of the rack 1 so as to adjust an installation orientation of the anchor rod. The lifting assembly 32 is configured to lift the drilling rig so that the drilling rig may drill the tunnel floor and the tunnel roof.

Figure 9:
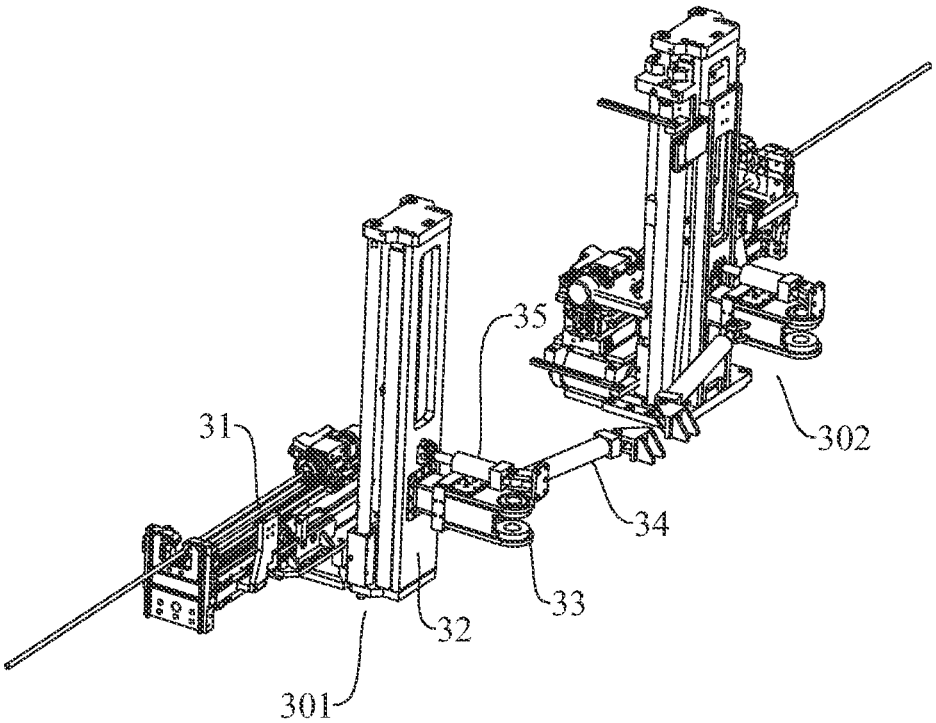
FIG. 9 is a front view of the drilling device in FIG. 8.

Specifically, as shown in FIG. 9, the lifting assembly 32 may be detachably mounted on the rack 1 through fasteners such as bolts and nuts, and include a hydraulic telescopic oil cylinder, which may extend along the up-down direction. The drilling rig 31 may be connected to the hydraulic telescopic oil cylinder, and the drilling rig 31 may move up and down through extension and retraction of the hydraulic telescopic oil cylinder. Therefore, the drilling rig 31 may perform drilling operations on both the tunnel floor and the tunnel roof, which makes the use of the drilling rig 31 more flexible.

It may be understood that, in some other embodiments, the lifting assembly 32 may also be other lifting assemblies 32, such as a scissor-type lifting apparatus and a lead screw drive apparatus.

Figure 10:
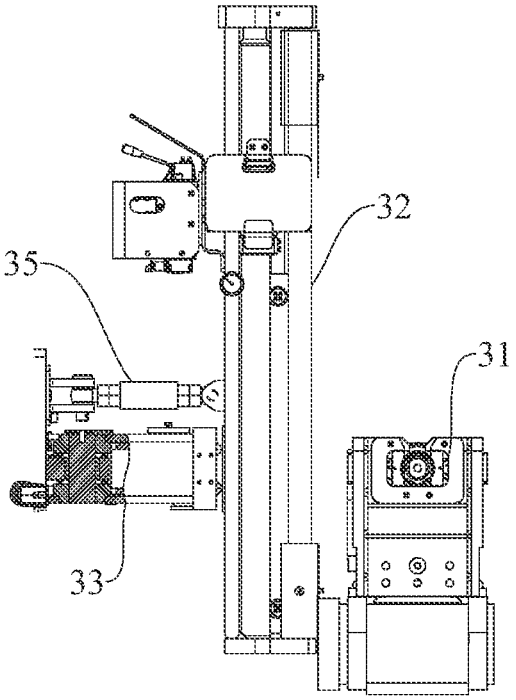
FIG. 10 is a side view of a single drilling device in FIG. 8.
Figure 11:
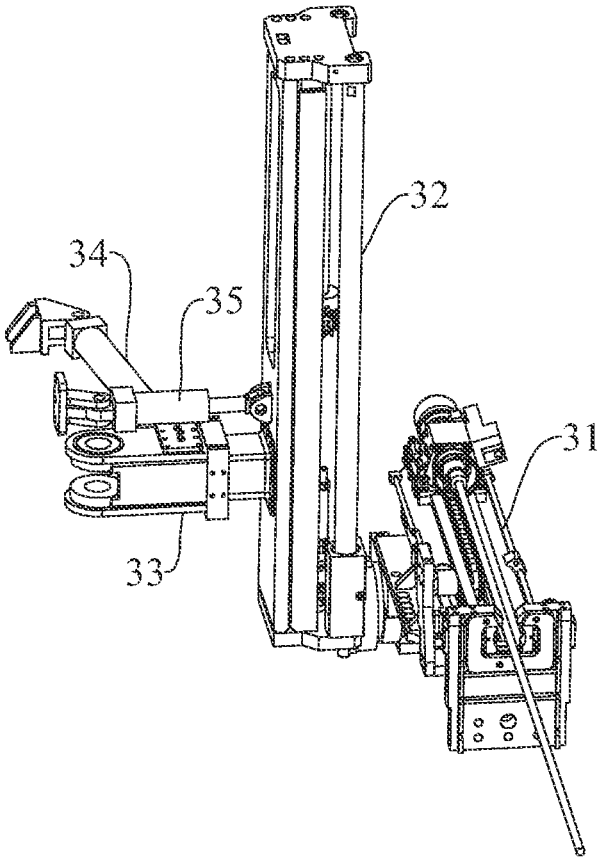
FIG. 11 is a perspective view of a single drilling device in FIG. 8.
Figure 12:
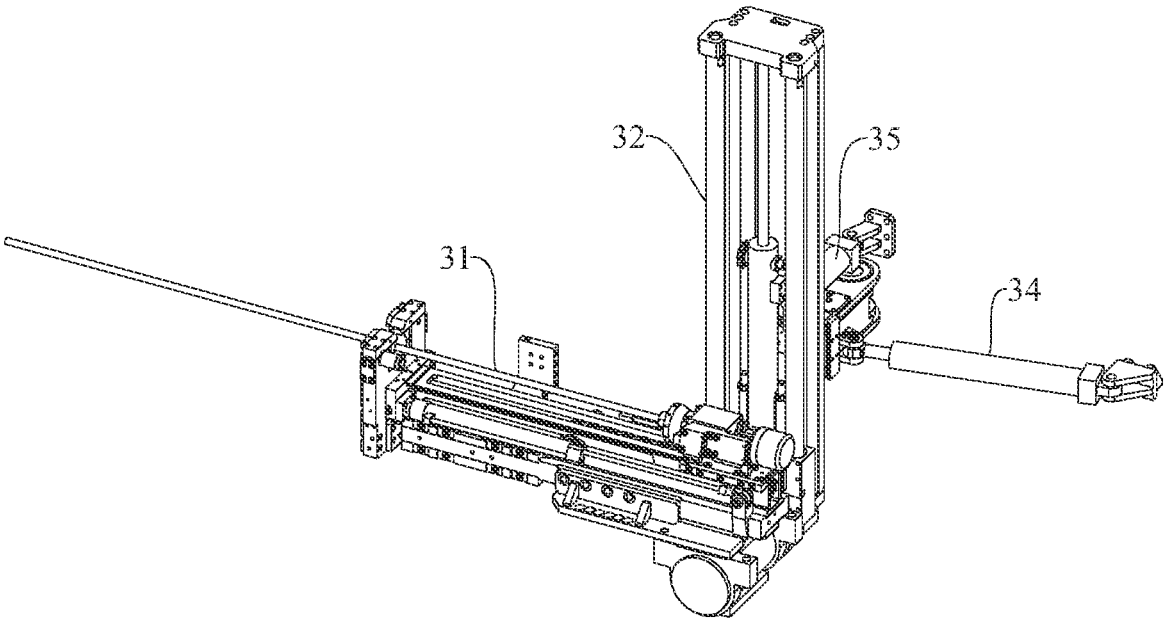
FIG. 12 is another perspective view of a single drilling device in FIG. 8.

As shown in FIGS. 10 and 11, the drilling rig 31 may be connected with the lifting assembly 32 through rotary drive (not shown), and the rotary drive may have two rotation axes. An extension direction of one rotation axis is the same as an extension direction of a connecting member 33, and the drilling rig 31 is rotatable around this rotation axis and hence may swing in the up-down direction (a height direction of the rack 1). The other rotation axis extends in the up-down direction, and the drilling rig 31 is rotatable around this rotation axis and hence may swing in the front-rear direction (the length direction of the rack 1).

Since the drilling rig 31 may swing and be adjusted in both the height direction and the length direction of the rack 1, and the drilling rig 31 may adjust its position in the up-down direction through the lifting assembly 32, the drilling rig 31 has a high degree of adjustment freedom in space, thus meeting the requirement of anchor rod installation in any orientation.

It should be noted that since the drive of a swinging driver 34 is accompanied by a change in an azimuth angle of the drilling rig 31, the drilling rig 31 may swing in the length direction of the rack 1 and thus the drilling rig 31 can be re-adjusted to a position perpendicular to a lateral wall of the tunnel, thereby facilitating the anchor rod installation.

In some embodiments, the drilling device 3 includes the connecting member 33 and the swinging driver 34. The connecting member 33 has a first end connected to the lifting assembly 32 and a second end rotatably connected to the rack 1. The swinging driver 34 has a first end rotatably connected to the rack 1 and a second end rotatably connected to the connecting member 33. The swinging driver 34 is configured to drive the connecting member 33 to swing in a width direction of the rack 1 to adjust a distance between the drilling rig 31 and the lateral wall of the tunnel.

Specifically, as shown in FIGS. 9 to 12, the drilling device 3 may be arranged at a rear end of the rack 1, and the connecting member 33 may be a connecting rod. The connecting member 33 has a first end connected and fixed to the rear end of the rack 1 by fasteners such as bolts, and a second end pivotally connected to the lifting assembly 32 with a pivot shaft extending in the up-down direction. Consequently, the connecting member 33 may only swing in the left-right direction.

The swinging driver 34 may a hydraulic telescopic oil cylinder, and has a first end hinged with the rack 1 and a second end hinged with the connecting member 33. In such a way, the swing drive of the connecting member 33 may be realized through extension and retraction of the swinging driver 34, and then the swing drive of the lifting assembly 32 and the drilling rig 31 in the left-right direction may be achieved, thereby facilitating the adjustment of the distance between the drilling rig 31 and the lateral wall of the tunnel.

In some embodiments, the drilling device 3 includes a displacement driver 35, an extension direction of the displacement driver 35 is the same as the extension direction of the connecting member 33. The displacement driver 35 has a first end rotatably connected to the rack 1 and a second end rotatably connected to the lifting assembly 32. The connecting member 33 and the displacement driver 35 may extend and retract synchronously. The displacement driver 35 is configured to drive the drilling rig 31 to move in the length direction of the rack 1 to adjust an installation row spacing of the anchor rod.

Specifically, as shown in FIGS. 9 to 12, the displacement driver 35 may a hydraulic telescopic oil cylinder, a rear end of the displacement driver 35 may be hinged or pivotally assembled with the lifting assembly 32, and a front end of the displacement driver 35 may be hinged or pivotally assembled with the rack 1. The displacement driver 35 and the connecting member 33 are arranged generally in parallel, and the connecting member 33 is telescopic. For example, the connecting member 33 may a telescopic rod. Both ends of the displacement driver 35 are hinged, so that the displacement driver 35 may swing, thus meeting swing requirements of the swinging driver 34.

Therefore, the lifting assembly 32 and the drilling rig 31 may move forwards and backwards through the extension and retraction of the displacement driver 35, so that the drilling rig 31 can meet the requirements of installation with different row spacing and is convenient to use.

It should be noted that the connecting member 33 can form a triangular structure with the rack 1 and the swinging driver 34, thus facilitating the swing drive of the drilling rig 31, and the connecting member 33 can withstand a shear force during operation of the drilling rig 31 and hence protect the displacement driver 35.

In some embodiments, the connecting member 33 includes an inner sleeve 332 and an outer sleeve 331. The inner sleeve 332 is fitted in the outer sleeve 331 and is slidable relative to the outer sleeve 331. A free end of the outer sleeve 331 is rotatably connected to the rack 1, and a free end of the inner sleeve 332 is rotatably connected to the lifting assembly 32. The swinging driver 34 is rotatably connected to the outer sleeve 331. The outer sleeve 331 is provided with an oil injection mouth configured to inject lubricating oil into the outer sleeve 331.

Figure 14:
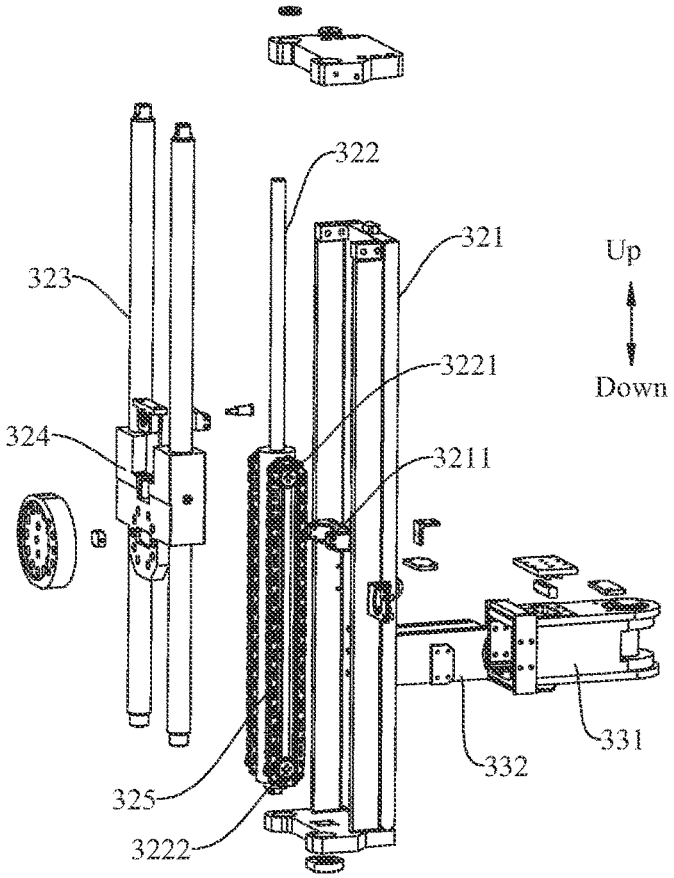
FIG. 14 is an exploded view of the lifting assembly in FIG. 13.

Specifically, as shown in FIG. 14, the inner sleeve 332 and the outer sleeve 331 are both square sleeves, and the square design of the inner sleeve 332 and the outer sleeve 331 has an anti-rotation effect, so that the inner sleeve 332 can only move along an axial direction of the connecting member 33. A rear end of the outer sleeve 331 is pivotally connected to the rack 1, the inner sleeve 332 is slidably assembled at a front end of the outer sleeve 331 in a guided manner, and a front end of the inner sleeve 332 is connected and fixed to the lifting assembly 32. The oil injection mouth may be arranged on a top surface of the outer sleeve 331 and is convenient to use. The lubricating oil may be injected into the outer sleeve 331 through the oil injection mouth, so that the inner sleeve 332 and the outer sleeve 331 can slide relative to each other more smoothly.

In some embodiments, the oil injection mouth may be provided with a protective structure, thus avoiding damage to the oil injection mouth during bolt support operations.

In some embodiments, the lifting assembly 32 includes a frame body 321, a lifting driver 322, a guide column 323, a mounting plate 324 and a chain 325. The guide column 323 is arranged on the frame body 321 and extends in the up-down direction. The mounting plate 324 is slidably assembled on the guide column 323 in a guided manner and is configured to mount the drilling rig 31. One end of the lifting driver 322 is connected to the frame body 321. The lifting driver 322 is provided with a first gear 3221 and a second gear 3222, which are spaced apart along an extension direction of the lifting driver 322. The chain 325 is engaged around outer peripheral sides of the first gear 3221 and the second gear 3222 and is connected to the mounting plate 324 and the frame body 321. The chain 325 is configured to translate and rotate to drive the mounting plate 324 to move, when the lifting driver 322 is extended and retracted.

Figure 13:
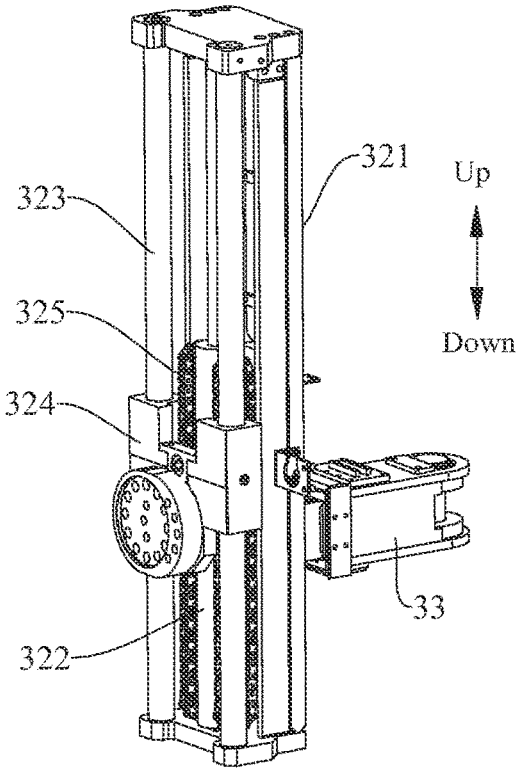
FIG. 13 is a schematic view of a lifting assembly of the drilling device in FIG. 12.

Specifically, as shown in FIG. 13 and FIG. 14, the frame body 321 may have a generally rectangular parallelepiped shape, and the frame body 321 extends in the up-down direction. The lifting driver 322 may be a hydraulic telescopic oil cylinder, and has a top end fixedly connected to a top end of the frame body 321 and a bottom end configured as a free end. The lifting driver 322 extends in the up-down direction and is telescopic in the up-down direction. The lifting driver 322 includes a piston rod and a cylinder body, the piston rod may be fixedly connected to the top end of the frame body 321, and a bottom end of the cylinder body is a free end.

Two guide columns 323 may be provided, both of which may be fixed to the frame body 321. The two guide columns 323 extend in the up-down direction and are spaced apart in the left-right direction. The mounting plate 324 is assembled on the two guide columns 323 in a guided manner and is slidable in the up-down direction. The drilling rig 31 may be connected to the mounting plate 324 through the rotary drive.

The first gear 3221 and the second gear 3222 may be arranged on an outer side of the cylinder body of the lifting driver 322 and are spaced apart in the up-down direction. Both the first gear 3221 and the second gear 3222 are rotatable relative to the cylinder body. The chain 325 may surround the outer peripheral sides of the first gear 3221 and the second gear 3222 and is engaged and assembled with both the first gear 3221 and the second gear 3222. A rear side of the chain 325 may be connected to the frame body 321, and a front side of the chain 325 may be connected to the mounting plate 324.

Consequently, when the cylinder body of the lifting driver 322 moves up and down, the chain 325 translates in the up-down direction and rotates around the first gear 3221 and the second gear 3222. Then, the rotating chain 325 drives the mounting plate 324 to move up and down, thereby driving the drilling rig 31 to move up and down. The arrangement of the chain 325 has a function of multiplying the displacement of the cylinder body of the lifting driver 322, thus increasing a movement stroke of the drilling rig 31.

In some embodiments, as shown in FIG. 14, the frame body 321 may be provided with a chain connecting portion 3211, the chain connecting portion 3211 is arranged in the middle of the frame body 321, and the rear side of the chain 325 may be detachably connected to the chain connecting portion 3211. The chain connecting portion 3211 may be provided with a matching groove, in which the cylinder body of the lifting driver 322 may be embedded, thereby enhancing a guiding effect of the lifting driver 322.

As shown in FIG. 14, the top end of the frame body 321 may be provided with an end plate, the end plate is detachably arranged on the frame body 321, and the lifting driver 322 and two guide columns 323 may be detachably connected to the end plate, thus facilitating the assembling and maintenance of the lifting assembly 32.

In some embodiments, the drilling device 3 may install the anchor rod, and the drilling device 3 includes a first drilling device 301 and a second drilling device 302. The first drilling device 301 and the second drilling device 302 are arranged at a tail end of the rack 1 and spaced apart along the width direction of the rack 1. The first drilling device 301 is configured to drill and install the anchor rod to a first lateral wall of the tunnel, and the second drilling device 302 is configured to drill and install the anchor rod to a second lateral wall of the tunnel.

Figure 7:
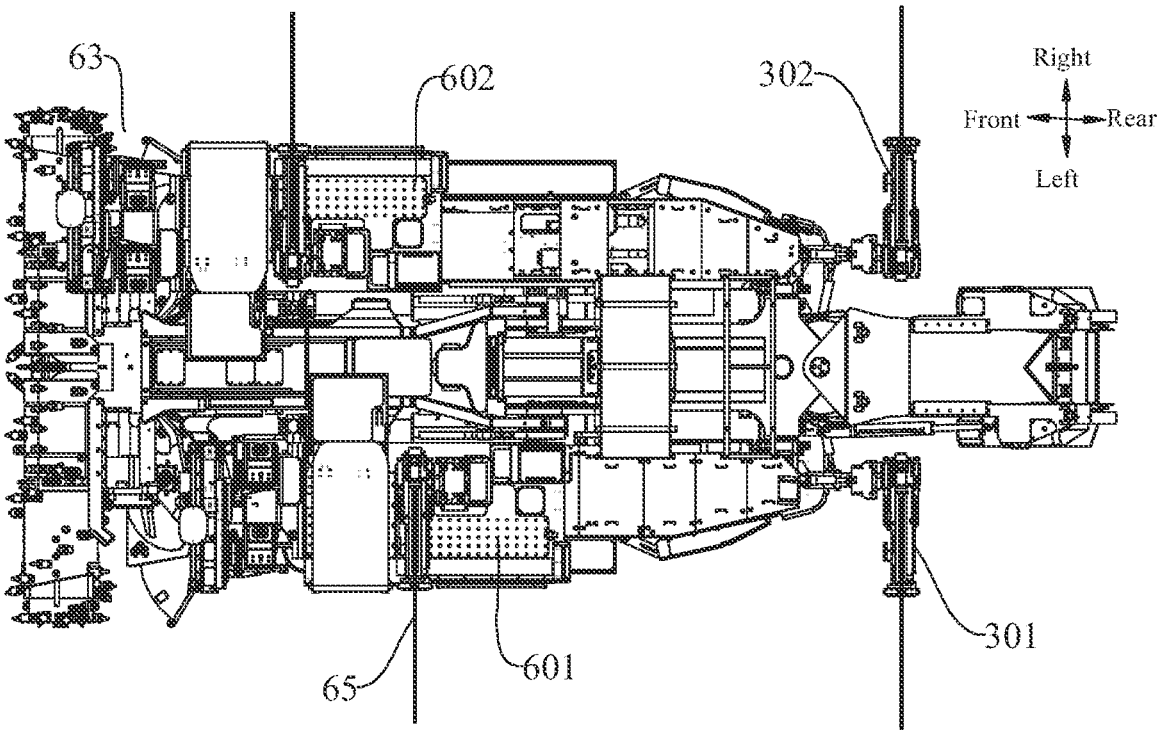
FIG. 7 is a top view of a bolter miner in FIG. 1.
Figure 8:
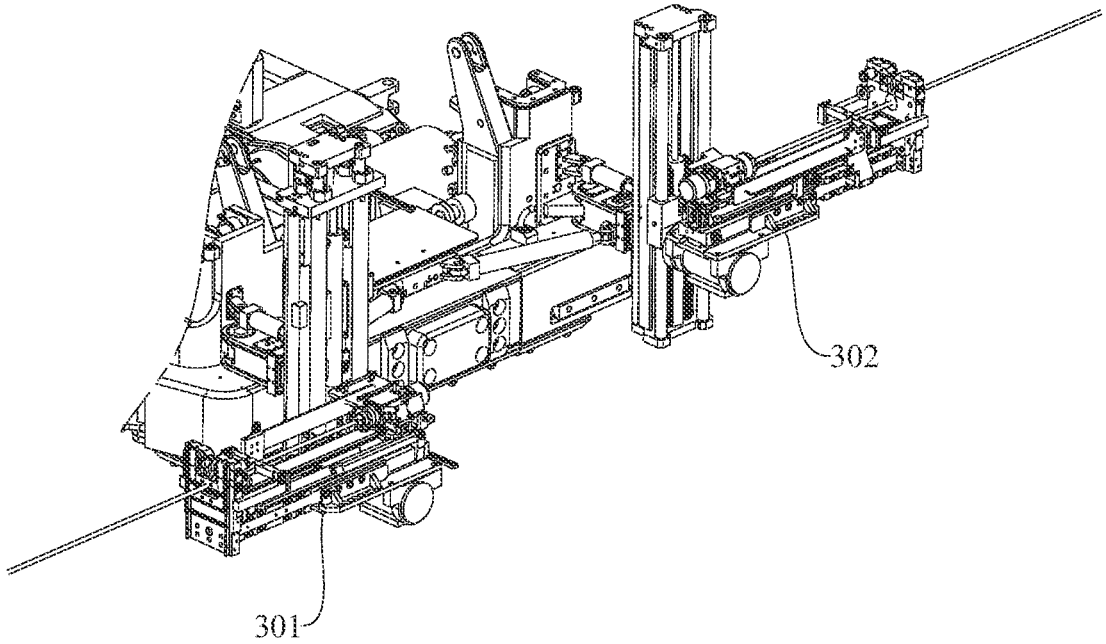
FIG. 8 is a rear view of a drilling device in FIG. 4.

Specifically, as shown in FIGS. 7 to 9, both the first drilling device 301 and the second drilling device 302 may be arranged on a rear side of the rack 1, the first drilling device 301 may be arranged on a left side of the rack 1, the second drilling device 302 may be arranged on a right side of the rack 1, and the first drilling device 301 and the second drilling device 302 are generally arranged in a mirror symmetry. The drilling rig 31 of the first drilling device 301 can swing to the left and is mainly used for bolt support for a left lateral wall of the tunnel, and the drilling rig 31 of the second drilling device 302 can swing to the right side and is mainly used for bolt support for a right lateral wall of the tunnel.

On the one hand, the arrangement of the first drilling device 301 and the second drilling device 302 can increase the bolt support efficiency and avoid a situation that a single drilling device 3 needs to move back and forth in the left-right direction. On the other hand, the two drilling devices 3 can drill at the same time, which is beneficial to reducing errors and improving the accuracy of monitoring.

In some embodiments, a size of an inlet of the shovel plate device 4 is adjustable. The conveying trough device 5 is arranged on the rack 1 and is located on a rear side of the shovel plate device 4, and is configured to convey coal rock gathered by the shovel plate device 4. The first drilling device 301 is arranged on a first side of the conveying trough device 5, and the second drilling device 302 is arranged on a second side of the conveying trough device 5.

Specifically, the shovel plate device 4 may be arranged at the front end of the rack 1, and the shovel plate device 4 includes a main shovel plate and two auxiliary shovel plates. The main shovel plate is connected to the rack 1, and the two auxiliary shovel plates are rotatably connected to left and right sides of the main shovel plate, respectively. A shovel plate driver may be arranged between each of the two auxiliary shovel plates and the main shovel plate. The swing drive of the corresponding auxiliary shovel plate can be realized through the extension and retraction of the shovel plate driver, so that the size of the inlet of the shovel plate can be adjusted. The conveying trough device 5 may be fixed on the rack 1 and extend in the front-rear direction. A front end of the conveying trough device 5 is docked with the shovel plate device 4, and the coal rock gathered by the shovel plate device 4 may be conveyed through the conveying trough device 5.

As shown in FIG. 7, the first drilling device 301 may be arranged on a left side of the conveying trough device 5, and the second drilling device 302 may be arranged on a right side of the conveying trough device 5, thus avoiding interference between the drilling device 3 and the conveying trough device 5.

In some embodiments, if the lithology of the tunnel roof is consistent with the lithology of the tunnel floor, the first threshold and the second threshold may be the same. Thus, the setting of the first threshold and the second threshold is simplified.

In some embodiments, the bolter miner 100 includes a bolt support device 6 that includes a lifting assembly 61, a work platform 62 and a first drilling frame assembly 63. The lifting assembly 61 is arranged between the rack 1 and the work platform 62 and is configured to raise and lower the work platform 62. The first drilling frame assembly 63 is arranged on the work platform 62. The work platform 62 is telescopic so that the first drilling frame assembly 63 can move to be above the cutting device 2. The first drilling frame assembly 63 is configured for bolt support for the tunnel roof above the cutting device 2 to reduce an unsupported roof distance.

Figure 15:
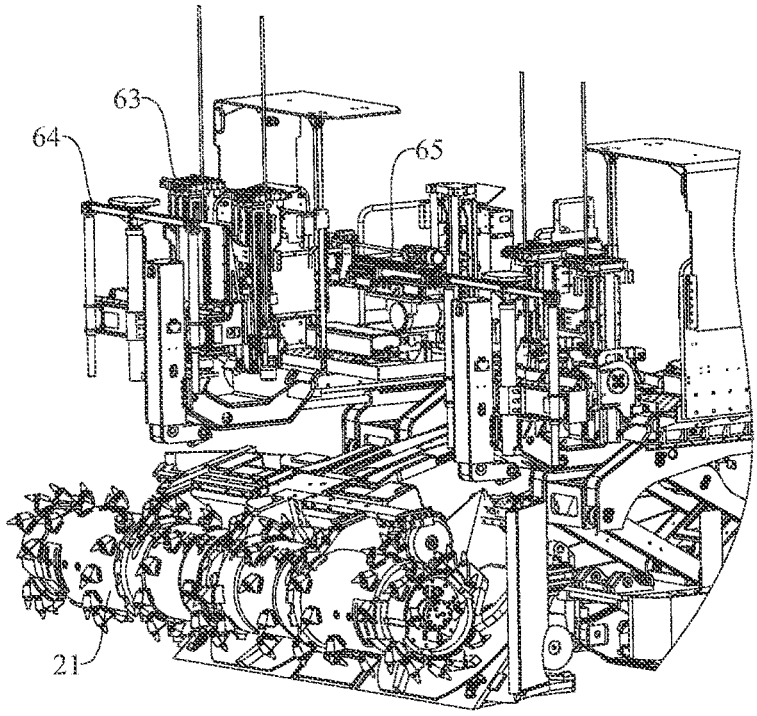
FIG. 15 is an assembly view of a bolt support device in FIG. 5.
Figure 16:
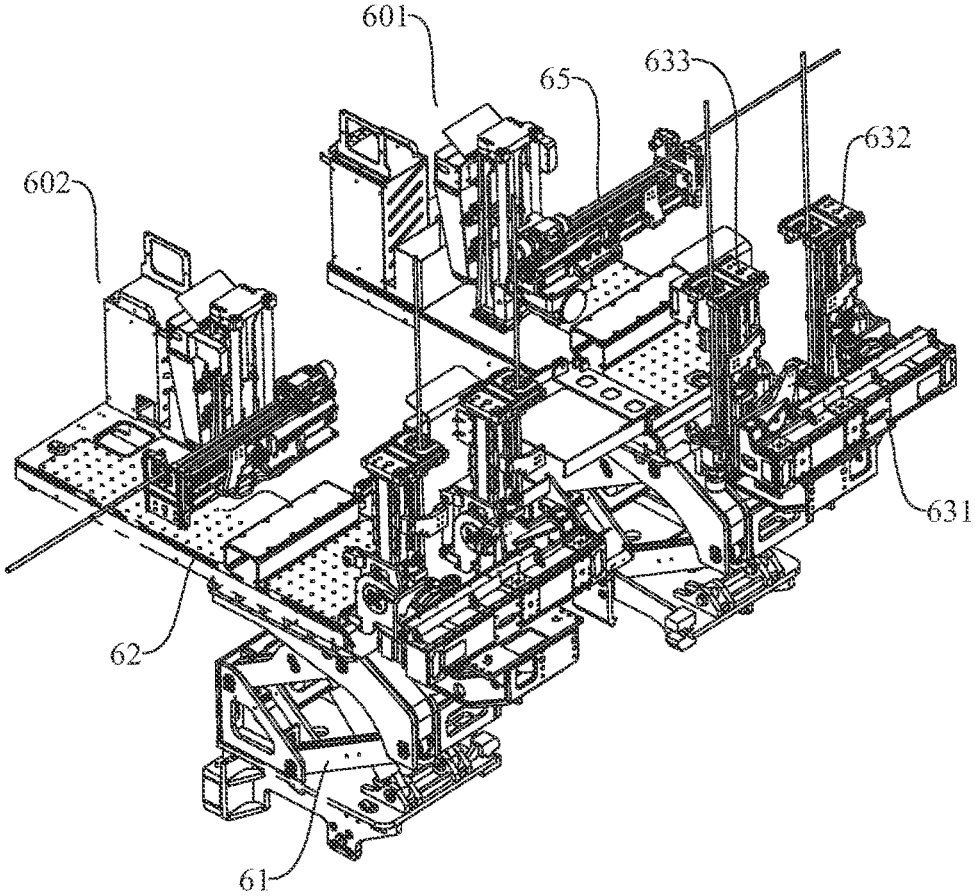
FIG. 16 is a schematic view of the bolt support device in FIG. 5.
Figure 17:
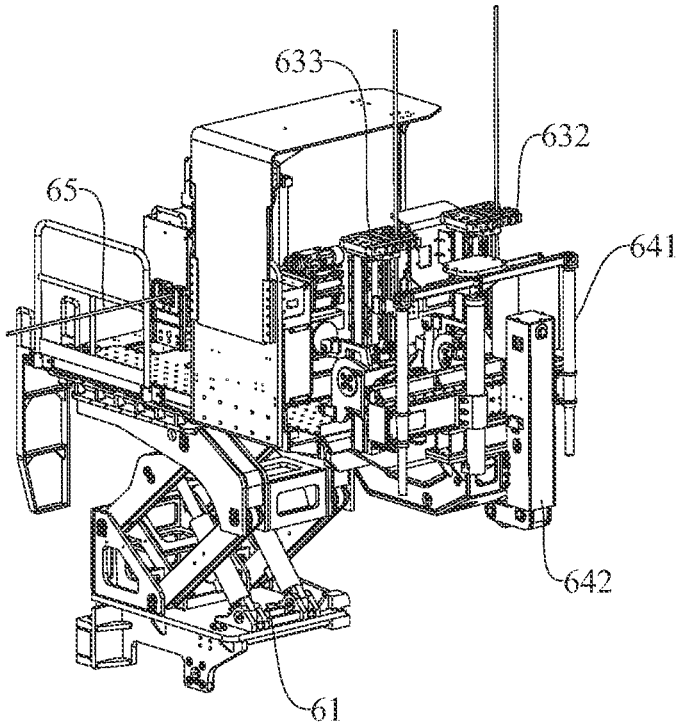
FIG. 17 is a perspective view of a single bolt support device in FIG. 16.

Specifically, as shown in FIG. 15 to FIG. 17, the lifting assembly 61 may be mounted on the rack 1, and the lifting assembly 61 may include a lifting platform and a lifting oil cylinder. The lifting platform is fixed at a top of the lifting oil cylinder, and the lifting platform may be driven to rise and fall by the lifting oil cylinder. The work platform 62 may be fixed on the lifting platform, and the rise and fall of the work platform 62 may be realized through the lifting assembly 61.

It should be noted that the work platform 62 may be a rectangular platform, extends in the front-rear direction and is telescopic in the front-rear direction. The first drilling frame assembly 63 may be mounted at a front end of the work platform 62, and the first drilling frame assembly 63 is used for bolt support operations. Specifically, when the work platform 62 extends forwards, the first drilling frame assembly 63 is generally located above the cutting drum 21 of the cutting device 2, and the first drilling frame assembly 63 may perform bolt support operations on the tunnel roof near the heading face.

When cutting operations are required, the work platform 62 may be retracted, and the first drilling frame assembly 63 is retreated to be behind the cutting drum 21 of the cutting device 2, so that the cutting device 2 can drive the cutting drum 21 to move up and down through the cutting arm, thus realizing the cutting operations and avoiding interference with the cutting device 2.

Consequently, the bolter miner 100 can realize parallel and non-parallel operations of tunneling and bolt support, and also can provide bolt support for the tunnel roof near the heading face, thus avoiding the existence of the unsupported roof distance at the heading face, and ensuring safe tunneling under poor conditions of the tunnel roof.

In some embodiments, as shown in FIG. 16, there may be two bolt support devices 6, i.e., a first bolt support device 601 and a second bolt support device 602. The first bolt support device 601 may be arranged on the left side of the rack 1, and the second bolt support device 602 may be arranged on the right side of the rack 1.

In some embodiments, the bolt support device 6 includes a stabilization assembly 64. The stabilization assembly 64 includes a first support assembly 641 and a second support assembly 642, which are arranged on the work platform 62. The first support assembly 641 may extend upwards and is configured to support the tunnel roof, and the second support assembly 642 may extend downwards and is configured to support the cutting device 2.

Specifically, as shown in FIGS. 15 to 17, the stabilization assembly 64 may be mounted at the front end of the work platform 62 and located on a front side of the first drilling frame assembly 63. The stabilization assembly 64 may be a telescopic oil cylinder. When the first drilling frame assembly 63 switches to a bolt support position, the stabilization assembly 64 may extend and be pressed against and in contact with a top side of the cutting device 2, thereby temporarily supporting the front end of the work platform 62, and avoiding a situation that the work platform 62 overhangs forwards relatively long. On the one hand, a problem that the work platform 62 tends to be bent and deformed can be avoided, and on the other hand, vibration of the first drilling frame assembly 63 during bolt support operations can be reduced, thus realizing a structural stabilization function.

It should be noted that in some other embodiments, the stabilization assembly 64 may also be pressed against and in contact with the tunnel roof, or the stabilization assembly 64 may also be pressed against and in contact with the tunnel roof and the cutting device 2 at the same time. In some other embodiments, the stabilization assembly 64 may also be pressed against and in contact with the lateral wall of the tunnel, thereby meeting the bolt support operations on the lateral wall of the tunnel.

As shown in FIG. 17, the stabilization assembly 64 may include a first support assembly 641 and a second support assembly 642. The first support assembly 641 and the second support assembly 642 are arranged on the work platform 62. The first support assembly 641 may extend upwards and is configured to support the tunnel roof. The second support assembly 642 may extend downwards and is configured to support the cutting device 2. Both the first support assembly 641 and the second support assembly 642 may be detachably mounted at the front end of the work platform 62 through fasteners such as bolts. Both the first support assembly 641 and the second support assembly 642 may be hydraulic telescopic cylinders. The first support assembly 641 may extend upwards and support the tunnel roof, and the second support assembly 642 may extend downwards and support the cutting device 2. On the one hand, the arrangement of the first support assembly 641 and the second support assembly 642 enhances the structural stability during the bolt support operation, and on the other hand, the first support assembly 641 and the second support assembly 642 may operate independently, thus improving the support reliability.

In some embodiments, the bolt support device 6 includes a second drilling frame assembly 65 arranged on the work platform 62, and the drilling device 3 may install the anchor rod. The second drilling frame assembly 65 is located between the first drilling frame assembly 63 and the drilling device 3 and is configured to cooperate with the drilling device 3 to provide bolt support for the lateral wall of the tunnel.

As shown in FIG. 7 and FIG. 16, the work platform 62 includes a first platform and a second platform. The second platform is fixed at a top end of the lifting assembly 61. The first platform and the second platform are slidably assembled in a guided manner and can extend forwards. The first drilling frame assembly 63 may be fixed at a front end of the first platform, and the second drilling frame assembly 65 may be fixed on the second platform. The first drilling frame assembly 63, the second drilling frame assembly 65 and the drilling device 3 may be sequentially arranged from the front to the rear and spaced apart from one another.

As shown in FIG. 16 and FIG. 17, the first drilling frame assembly 63 may include a first anchor drill 632, a second anchor drill 633 and a mounting seat 631. The mounting seat 631 is fixed at the front end of the first platform. The first anchor drill 632 and the second anchor drill 633 are mounted on the mounting seat 631. The first anchor drill 632 and the second anchor drill 633 may rotate, to realize bolt support for the lateral wall and the roof.

The second drilling frame assembly 65 includes a third anchor drill that may rotate and provide bolt support for the lateral wall of the tunnel.

In some embodiments, the bolter miner 100 includes a propping device (not shown), which includes a first propping device and a second propping device. The first propping device is arranged on one side of the rack 1, and the first propping device may be propped between a first lateral wall of the tunnel and the rack 1. The second propping device is arranged on the other side of the rack 1, and the second propping device may be propped between a second lateral wall of the tunnel and the rack 1.

Specifically, the propping device may be a propping oil cylinder, may extend along the width direction of the rack 1 and can prop the lateral wall of the tunnel. Two propping devices may be provided, i.e., the first propping device and the second propping device. The first propping device may be arranged on the left side of the rack 1, extend to the left and prop a left lateral wall of the tunnel. The second propping device may be arranged on the right side of the rack 1, extend to the right and prop a right lateral wall of the tunnel. Hence, when in use, the bolter miner 100 may be propped and fixed between two lateral walls of the tunnel through the propping device, thus ensuring the stability of the bolter miner 100 during operation.

In some embodiments, the drilling device 3 performs a drilling operation on the tunnel floor, which may include the following steps S1 to S5.

At step S1, the number of cycle footage advanced by the cutting device 2 is determined according to a thickness of a coal seam. For example, when the coal seam is thick, the bolter miner 100 may be advanced by much cycle footage before the drilling operation, that is, the bolter miner 100 may be advanced by a large distance between two adjacent drilling operations.

At step S2, a drilling position on the tunnel floor is determined after the cutting device 2 is advanced by the determined number of cycle footage. For example, any area on the tunnel floor may be selected, which will be a subsequent drilling position. In some embodiments, in order to reduce errors, a plurality of drilling positions may be selected on the tunnel floor, and drilling may be carried out on all the plurality of drilling positions.

At step S3, the rack 1 is driven to move, the drilling device 3 is moved to a position corresponding to the drilling position on the tunnel floor, and then the tunnel floor is drilled by the drilling device 3.

At step S4, a monitoring data signal is transmitted to the control device in real time by the sensor in a process of drilling the tunnel floor by a first thickness through the drilling device 3.

At step S5, the control device analyzes and compares the monitoring data signal and the first threshold in real time, and corrects the lowest swing angle of the cutting device 2 in the control device if the monitoring data signal is greater than the first threshold. Specifically, in the process of drilling the tunnel floor by the first thickness, if the monitoring data signal is greater than the first threshold, the drilling operation may be stopped, and then the lowest swing angle preset in the control device may be reduced, so that in the subsequent cutting operation, the cutting arm of the cutting device 2 may reduce a cutting depth of the tunnel floor and correct the cutting direction.

It should be noted that when there are the plurality of drilling positions, the monitoring data signals of the plurality of drilling positions may be averaged and then compared with the first threshold.

In some embodiments, the drilling device 3 performs a drilling operation on the tunnel roof, which may include the following steps S1 to S5.

At step S1, the number of cycle footage advanced by the cutting device 2 is determined according to a thickness of a coal seam.

At step S2, a drilling position on the tunnel roof is determined after the cutting device 2 is advanced by the determined number of cycle footage. For example, any area on the tunnel roof may be selected, which will be a subsequent drilling position. In some embodiments, in order to reduce errors, a plurality of drilling positions may be selected on the tunnel roof, and drilling may be carried out on all the plurality of drilling positions.

At step S3, the rack 1 is driven to move, the drilling device 3 is moved to a position corresponding to the drilling position on the tunnel roof, and then the tunnel roof is drilled by the drilling device 3.

At step S4, a monitoring data signal is transmitted to the control device in real time by the sensor in a process of drilling the tunnel roof by a second thickness through the drilling device 3.

At step S5, the control device analyzes and compares the monitoring data signal and the second threshold in real time, and corrects the highest swing angle of the cutting device 2 in the control device if the monitoring data signal is greater than the second threshold. Specifically, in the process of drilling the tunnel roof by the second thickness, if the monitoring data signal is greater than the second threshold, the drilling operation may be stopped, and then the highest swing angle preset in the control device may be reduced, so that in the subsequent cutting operation, the cutting arm of the cutting device 2 may reduce a cutting depth of the tunnel roof and correct the cutting direction.

In the description of the present disclosure, it is to be understood that terms such as "central," "longitudinal," "transverse," "length," "width," "thickness," "upper,"

"lower," "front," "rear," "left," "right," "vertical," "horizontal," "top," "bottom," "inner," "outer," "clockwise," "counterclockwise," "axial," "radial" and "circumferential" should be construed to refer to the orientation as then described or as shown in the drawings under discussion. These relative terms are for convenience and simplicity of description and do not indicate or imply that the devices or elements referred to have a particular orientation and be constructed or operated in a particular orientation. Thus, these terms shall not be construed as limitation on the present disclosure.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present disclosure, the term "a plurality of" means at least two, such as two or three, unless specified otherwise.

In the present disclosure, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communication or interaction of two elements, which can be understood by those skilled in the art according to specific situations.

In the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Reference throughout this specification to "an embodiment," "some embodiments," "an example," "a specific example," or "some examples," means that a particular feature, structure, material, or characteristic described in connection with the embodiment or example is included in at least one embodiment or example of the present disclosure. Thus, the above terms throughout this specification are not necessarily referring to the same embodiment or example of the present disclosure. Furthermore, the particular features, structures, materials, or characteristics may be combined in any suitable manner in one or more embodiments or examples. Moreover, those skilled in the art can integrate and combine the different embodiments or examples and the features of the different embodiments or examples described in this specification without contradicting each other.

Although embodiments of the present disclosure have been shown and described, it can be appreciated by those skilled in the art that the above embodiments are merely exemplary and are not intended to limit the present disclosure, and various changes, modifications, alternatives and variations may be made in the embodiments within the scope of the present disclosure.

The invention claimed is:

1. A tunnel tunneling system, comprising:

a bolter miner comprising a rack, a cutting device, a drilling device and a control device, wherein the cutting device is arranged on the rack and is swingable in an up-down direction, and the cutting device has a lowest swing angle and a highest swing angle; the drilling device is arranged on the rack, the drilling device comprises a drilling rig and a sensor, the drilling rig is configured to drill at least one of a tunnel floor and a tunnel roof, and the sensor is configured to monitor a set parameter of the drilling rig and generate a monitoring data signal when the drilling rig is drilling; the control device is configured to receive and analyze the monitoring data signal; in a process of drilling the tunnel floor by a first thickness through the drilling rig, the control device is configured to reduce the lowest swing angle in response to that the monitoring data signal is greater than a first threshold; and in a process of drilling the tunnel roof by a second thickness through the drilling rig, the control device is configured to reduce the highest swing angle in response to that the monitoring data signal is greater than a second threshold, wherein the first threshold is a numerical parameter corresponding to a propulsion force when breaking through an interface between a coal seam and a rock stratum below the coal seam, and the second threshold is a numerical parameter corresponding to a propulsion force when breaking through an interface between the coal seam and a rock stratum above the coal seam;

wherein the drilling device includes a first lifting assembly connected with the rack, the drilling rig is arranged on the first lifting assembly and configured to install an anchor rod, the drilling rig is rotatably connected with the first lifting assembly, the drilling rig is swingable in a height direction and a length direction of the rack to adjust an installation orientation of the anchor rod, and the first lifting assembly is configured to lift the drilling rig to allow the drilling rig to drill the tunnel floor and the tunnel roof;

a bolter-integrated transportation machine arranged behind the bolter miner and configured to transfer coal rock cut and conveyed by the bolter miner;

a transfer machine and a self-moving tail, wherein one end of the transfer machine is connected with the bolter-integrated transportation machine and is configured to move synchronously with the bolter-integrated transportation machine, the transfer machine is arranged behind the bolter-integrated transportation machine, the transfer machine is configured to transfer the coal rock conveyed by the bolter-integrated transportation machine, the other end of the transfer machine is lapped with the self-moving tail, and the self-moving tail is configured to transfer the coal rock conveyed by the transfer machine and to move backwards for retreat; and a belt conveyor arranged behind the self-moving tail, and configured to transfer the coal rock conveyed by the self-moving tail.

2. The tunnel tunneling system according to claim 1, wherein the self-moving tail comprises a self-moving bracket and a driving device, the self-moving bracket is arranged at a front end of the self-moving tail, the driving device is arranged at a rear end of the self-moving tail, the self-moving tail is configured to walk to drive the self-moving tail to move forwards, and the driving device is configured to drive the self-moving tail to move backwards.

3. The tunnel tunneling system according to claim 1, wherein the drilling device comprises a connecting member and a swinging driver, the connecting member has a first end connected to the first lifting assembly and a second end rotatably connected to the rack, the swinging driver has a first end rotatably connected to the rack and a second end rotatably connected to the connecting member, and the swinging driver is configured to drive the connecting member to swing in a width direction of the rack to adjust a distance between the drilling rig and a lateral wall of a tunnel.

4. The tunnel tunneling system according to claim 3, wherein the drilling device comprises a displacement driver, an extension direction of the displacement driver is identical to an extension direction of the connecting member, the displacement driver has a first end rotatably connected to the rack and a second end rotatably connected to the first lifting assembly, the connecting member and the displacement driver are configured to extend and retract synchronously, and the displacement driver is configured to drive the drilling rig to move in the length direction of the rack to adjust an installation row spacing of the anchor rod.

5. The tunnel tunneling system according to claim 3, wherein the connecting member comprises an inner sleeve and an outer sleeve, the inner sleeve is fitted in the outer sleeve and is slidable relative to the outer sleeve, a free end of the outer sleeve is rotatably connected to the rack, a free end of the inner sleeve is rotatably connected to the first lifting assembly, the swinging driver is rotatably connected to the outer sleeve, and the outer sleeve is provided with an oil injection mouth configured to inject lubricating oil into the outer sleeve.

6. The tunnel tunneling system according to claim 1, wherein the first lifting assembly comprises a frame body, a lifting driver, a guide column, a mounting plate and a chain, the guide column is arranged on the frame body and extends in the up-down direction, the mounting plate is slidably assembled on the guide column in a guided manner and is configured to mount the drilling rig, an end of the lifting driver is connected to the frame body, the lifting driver is provided with a first gear and a second gear, the first gear and the second gear are spaced apart along an extension direction of the lifting driver, the chain is engaged around outer peripheral sides of the first gear and the second gear and is connected to the mounting plate and the frame body, and the chain is configured to translate and rotate to drive the mounting plate to move, when the lifting driver is extended and retracted.

7. The tunnel tunneling system according to claim 1, wherein the drilling device is configured to install an anchor rod and comprises a first drilling device and a second drilling device, the first drilling device and the second drilling device are arranged at a tail end of the rack and spaced apart along a width direction of the rack, the first drilling device is configured to drill and install the anchor rod to a first lateral wall of the tunnel, and the second drilling device is configured to drill and install the anchor rod to a second lateral wall of the tunnel.

8. The tunnel tunneling system according to claim 1, wherein the bolter miner comprises a bolt support device, and the bolt support device comprises a second lifting assembly, a work platform and a first drilling frame assembly, wherein the second lifting assembly is arranged between the rack and the work platform and is configured to raise and lower the work platform, the first drilling frame assembly is arranged on the work platform, the work platform is telescopic to allow the first drilling frame assembly to move to be above the cutting device, and the first drilling frame assembly is configured for bolt support for the tunnel roof above the cutting device to reduce an unsupported roof distance.

9. The tunnel tunneling system according to claim 8, wherein the bolt support device comprises a stabilization assembly, the stabilization assembly comprises a first support assembly and a second support assembly, the first support assembly and the second support assembly are arranged on the work platform, the first support assembly extends upwards and is configured to support the tunnel roof, and the second support assembly extends downwards and is configured to support the cutting device.

10. The tunnel tunneling system according to claim 8, wherein the bolt support device comprises a second drilling frame assembly arranged on the work platform, the drilling device is configured to install an anchor rod, and the second drilling frame assembly is arranged between the first drilling frame assembly and the drilling device and is configured to cooperate with the drilling device to provide bolt support for a lateral wall of a tunnel.

11. The tunnel tunneling system according to claim 1, wherein the drilling device performs a drilling operation on the tunnel floor by:

determining the number of cycle footage advanced by the cutting device according to a thickness of a coal seam;

determining a drilling position on the tunnel floor after the cutting device is advanced by the determined number of cycle footage;

driving the rack to move, moving the drilling device to a position corresponding to the drilling position on the tunnel floor, and drilling the tunnel floor by the drilling device;

transmitting a monitoring data signal to the control device in real time by the sensor in a process of drilling the tunnel floor by a first thickness through the drilling device; and analyzing and comparing, by the control device, the monitoring data signal and the first threshold in real time, and correcting the lowest swing angle of the cutting device in the control device in response to that the monitoring data signal is greater than the first threshold.

12. The tunnel tunneling system according to claim 1, wherein the drilling device performs a drilling operation on the tunnel roof by:

determining the number of cycle footage advanced by the cutting device according to a thickness of a coal seam;

determining a drilling position on the tunnel roof after the cutting device is advanced by the determined number of cycle footage;

driving the rack to move, moving the drilling device to a position corresponding to the drilling position on the tunnel roof, and drilling the tunnel roof by the drilling device;

transmitting a monitoring data signal to the control device in real time by the sensor in a process of drilling the tunnel roof by a second thickness through the drilling device; and analyzing and comparing, by the control device, the monitoring data signal and the second threshold in real time, and correcting the highest swing angle of the cutting device in the control device in response to that the monitoring data signal is greater than the second threshold.

* * * * *